United States Patent [19]

Nearhood

[11] Patent Number: 5,050,245

[45] Date of Patent: Sep. 24, 1991

[54] CEPHALIC TOOL FOR CONSTRUCTION OF A CEILING

[76] Inventor: David L. Nearhood, 27 Swan St., Lambertville, N.J. 08530

[21] Appl. No.: 512,938

[22] Filed: Apr. 23, 1990

[51] Int. Cl.[5] ..... A42B 1/06

[52] U.S. Cl. ..... 2/410; 224/181

[58] Field of Search ..... 2/1, 2, 410, 175, 205, 2/185 R, 190; 224/181-257; 269/3

[56] References Cited

U.S. PATENT DOCUMENTS

| | | | |
|---|---|---|---|
| 1,859,313 | 5/1932 | Pereles | 2/425 |
| 2,619,639 | 12/1952 | Hendler | 2/181.2 |
| 3,028,059 | 4/1962 | Greenwood | 224/181 |
| 3,039,765 | 6/1962 | Tate | 224/257 |
| 3,229,872 | 1/1966 | Williams | 224/181 |
| 3,274,612 | 9/1966 | Merriam | 2/425 |
| 3,800,989 | 4/1974 | Kallander | 224/181 |
| 4,443,891 | 4/1984 | Blomgren et al. | 2/414 |
| 4,581,773 | 4/1986 | Cunnane | 2/411 |
| 4,649,846 | 3/1987 | Javanelle | 224/181 |
| 4,745,637 | 5/1988 | Steele et al. | 2/411 |
| 4,874,120 | 10/1989 | Paton et al. | 224/181 |

FOREIGN PATENT DOCUMENTS

| | | | |
|---|---|---|---|
| 928195 | 5/1947 | France | 224/181 |
| 1430229 | 1/1966 | France | 2/410 |

*Primary Examiner*—Werner H. Schroeder
*Assistant Examiner*—Michael A. Neas
*Attorney, Agent, or Firm*—William L. Muckelroy

[57] ABSTRACT

A combination protective head gear and cephalic tool for construction workers is made of a thick cylindrical member having therein a soft cushioning material attached to a thin, relatively hard disk, the cylindrical member being enclosed in a fabric and adapted with straps to fit snugly on top of a wearer's head to provide the construction worker with a tool for carrying large sheets of building material and which tool allows manipulating and orienting the building material sheet while on top of the head into place for construction of a ceiling.

7 Claims, 1 Drawing Sheet

CEPHALIC TOOL FOR CONSTRUCTION OF A CEILING

BACKGROUND OF THE INVENTION

1. Field of the Invention

This invention relates broadly to protective head gear and specifically to the adaptation of head gear for use in conjunction with cephalic manipulation of ceiling boards such that the head gear is also used as a tool for facilitating the construction of ceilings as well as generally protecting the head of the construction worker from the ceiling boards.

2. Description Of The Prior Art

Many head protecting devices are on the market such as helmets for motorcycling and the like. None of these are designed to protect the head from injuries as well as provide for the head to be used with a tool for manipulating an object placed on the top thereof. This application presents a novel improvement over such helmets as, for example, the head protector disclosed by Steele, et al in U.S. Pat. No. 4,745,637; the head protector disclosed by Pereles in U.S. Pat. No. 1,859,313; and the protective hat disclosed by Cunnane in U.S. Pat. No. 4,581,773.

Of note, Cunnane discloses a protective head gear particularly for infants and young children constructed of a core of impact absorbent foam encapsulated with a shell of textile fabric material providing the inner and outer surfaces of the garment. However, Cunnane neither addresses the utilization of head gear as a tool nor specifically the adaptation of the head gear to manipulate ceiling boards for installation thereof.

Hendler in U.S. Pat. No. 2,619,639, entitled "Protective Helmet for High-Speed Aircraft", provides a Fiberglas TM helmet shaped to closely fit the contour of the human head wherein foam rubber pads are placed inside of the shell inside of a chamois skin covering. In 1984, Blomgren, et al were granted U.S. Pat. No. 4,443,891 for a bicycle helmet made of a shell of flexible and hard plate shaped material with extended cross pieces with tips attached to radiate between the cross pieces. Unique to the invention is that the attachment means can be arranged so that the width and size of the shell can be adjusted with a damping means formed substantially of foamed plastic.

As early as 1966 Merriam was granted a U.S. Pat. No. 3,274,612 entitled "Helmet for Water Sports". This patent was designed to be light weight, buoyant, to fit comfortably, to be safely worn in the water, and to provide a means for escape of water that would otherwise be entrapped in the helmet. None of these patents address the need to use a helmet item as a tool for the installation of ceiling material.

It is therefore, a principal object of this invention to provide a tool for installation of ceiling boards made of gypsum or other material as well as a protective head gear for a construction worker which insulates the construction material from the head to avoid creasing of the material. It is another object to provide a protective separation which minimizes the loss of hair, redness, skin peeling, repeated pressure to points on the head, as well as irritation to the top of the head.

In the industry, construction workers have complained for years of their heads becoming tender and of eventual calluses formed on the top of the head due to having to carry and support large heavy boards of gypsum, plywood and the like used in the construction of ceilings. A typical ceiling construction worker customarily utilizes his head to support the ceiling material while securing same in place or while same is being secured in place by another worker.

SUMMARY OF THE INVENTION

The foregoing and other objects of this invention are realized, in a presently preferred form of the invention, by providing a thick cylindrical cushioned member on top of the head having a concave construction on the bottom side thereof adapted to fit on top of the head as well as a flat top surface adapted to receive a large panel of ceiling material and enable a worker to carry that ceiling material on top of his head. The novel invention is a tool for use in conjunction with the use of hands and movement of the head in a manner so as to cause insertion of the panel into an appropriate pre-selected place in a ceiling.

In one construction of the invention, a head receiving member is fabricated from a thick circular piece, of foam rubber. The piece is a cylinder with its bottom resembling an egg carton. The cylinder is made of a soft spongy material and is covered by a tightly woven fabric such as silky nylon cloth. To absorb the repeated impact of boards being carried and manipulated by the head over a work day period, the cylinder has a disk attached to the top and is placed with the apex portion of cones formed in the foam directed against the top surface of the head. A V-shaped strap is attached on each side of the cylinder such that one strap extends down the left side of the face and the other strap extends down the right side of the face. The bottom of the v of each strap is interconnected to the other by means of a Velcro TM fastener.

The invention in its present form minimizes discomfort to the head from pushing up on boards and holding them while fastening the boards to a ceiling and in addition provides easier manipulation of the location and positioning of boards.

There is seen in the drawings a form of the invention which is presently preferred (and which represents the best mode contemplated at present for carrying the invention into effect), but it should be understood that the invention is not limited to the precise arrangements and parts shown.

DETAILED DESCRIPTION OF THE PREFERRED EMBODIMENT

Figure 1:
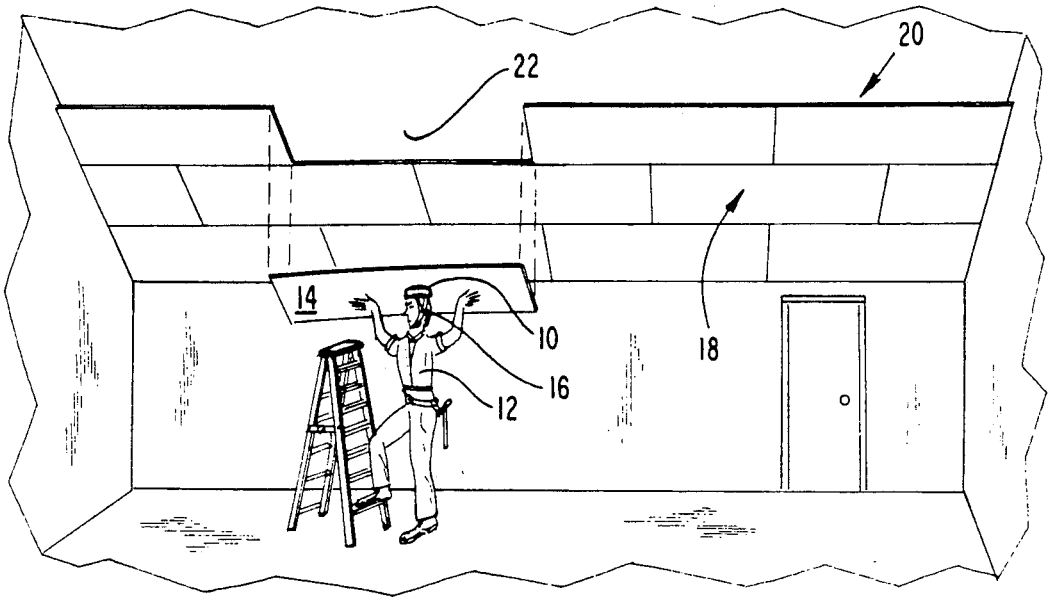
FIG. 1 is a perspective view of a construction worker utilizing a novel cephalic tool in accordance with the present invention.

Referring to the drawings in detail wherein like reference numerals indicate like elements of the novel invention, there is seen in FIG. 1 in use during the construction of a ceiling an instrument such as, for example, a cephalic tool 10 worn by a construction worker 12.

The worker 12 is shown wearing the cephalic tool 10 on the head. The worker 12 is carrying a large ceiling building material, for example, a flat board 14 on top of the head by means of the tool 10. The board 14 is supported by the tool 10 and is shown being manipulated into place by means of cephalic movements of the head of the worker 12 via the tool 10.

The cephalic tool 10 is adapted to fit on top of the head snugly. The tool 10 is affixed to the head by means of straps 16 and 18. The cephalic tool 10 is shown being used by the worker 12 to construct a ceiling 18 for a room 20. The ceiling 18 is comprised of other flat boards similar to the board 14 which are raised into place and secured there by the worker 12, for example.

The cephalic tool 10 in FIG. 1 has a core element 72 (see FIG. 4) which serves two major functions for the worker 12: (1) It provides a substantially flat surface for manipulating and moving the position of the board 14 during insertion into a space 22 (this is much more effective and efficient than just utilizing the concave surface of the head); (2) The tool 10 with the core element 72 also protects the head of the worker 12 during the course of the work involved in the installation of the various panels of the ceiling 18 preventing scratching, irritation, dust and splinter impregnation as well as general irritation of the skin on top of the head.

Figure 2:
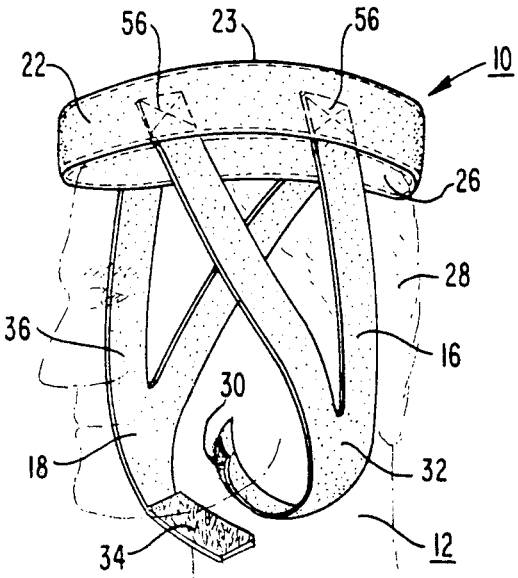
FIG. 2 is a close up perspective view of the cephalic tool shown mounted on a human head.

As shown in FIG. 2 the cephalic tool 10 is made of a thick cylindrical member 22 with a core element 72 having a top surface 23 which is substantially flat and a bottom surface 26 which is concave and thereby adapted to fit the curvature of the head 28 of the worker 12.

As further shown in FIG. 2 the cephalic tool 10 is also made of a left V-shaped strap 16 having a Velcro TM pad 30 attached to the end thereof on the outside surface 32 and another right V-shaped strap member 18 having a Velcro TM pad 34 attached at the end of the strap 18 on the inside surface 36 thereof. The Velcro TM members 30 and 34 are adapted to be interconnected such that they firmly and snugly secure the cephalic tool 10 about the head 28 of the worker 12. The straps 16 and 18 in combination with the Velcro pads 30 and 34 attached respectively thereto make up an attachment means for attachment of the cephalic tool 10 to the head 28. Hence, when the cephalic tool 10 is firmly attached to the head 28 it provides a construction worker 12 with a means for cephalically manipulating a large flat board or similar building material such as, for example, the board 14 (shown in FIG. 1) used for construction of the ceiling 18 of a room 20 (See FIG. 1).

Figure 3:
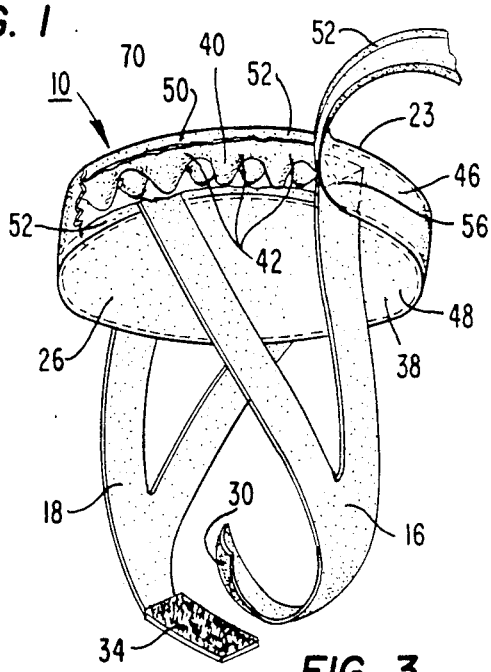
FIG. 3 is a perspective view, partly exploded, showing the internal construction of the novel tool.

The thick cylindrical member 22 making up a portion of the cephalic tool 10 as shown in FIG. 3 is covered with a tightly woven synthetic cloth covering 38. Inside the covering 38 which may, for example, be made of nylon, there is shown a soft, spongy material 40, thick and cylindrical in shape and made, for example, of a foam rubber "egg carton" cushion. The spongy material 40, cylindrical in shape, with numerous bulbous mounds 42 is oriented such that the mounds 42 point downward towards the bottom 26 of the cylindrical member 22. The cylindrical mounds 42 act as shock absorbers absorbing pressure and movement from a board 14 carried on the top surface 23 of the tool (See FIG. 1).

The covering 38 is made up of three members: A side band 46, a bottom member 48 and a top member 50. These members are joined together by cement, for example, at their interfaces 52, for example. Alternatively, the top member 50 may be interconnected to the bottom member 48 by means of an elongated rectangular strip, side band 46 for example, which wraps around the cylindrical side wall of an interior cylindrical member, the spongy material 40 for example, by means of stitching 54 or stitching 54 in conjunction with eighter glue, epoxy, contact cement or the like, for example. The straps 16 and 18 are sewn, for example, to the band 46 by means of stitches 56 at points where the straps 16 and 18 come into contact with the side band 46. The top member 50 as well as the bottom member 48 and the side band 46 each have a hem 70 at the adjoining edges thereof for both joining together by sewing and/or by glueing with epoxy or the like.

Figure 4:
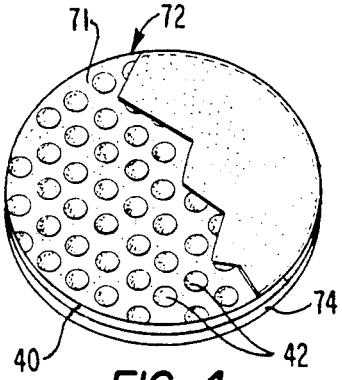
FIG. 4 is a bottom view of a core element used for the internal construction of the cylindrical member in the present invention.

In FIG. 4 there is shown a bottom view of the spongy material 40 which makes up part of the inside the top piece 22 of the cephalic tool 10. There are shown the mounds 42. The mounds 42, approximately 0.75 inches at their base for example, protrude approximately 0.75 inch, for example, from a base member portion 71 of the spongy material 40. The portion 71 is approximately 0.75 inch in thickness, for example. The core element 72 is a bi-layered structure made of the spongy material 40 adjacent a disk 74.

Figure 5:
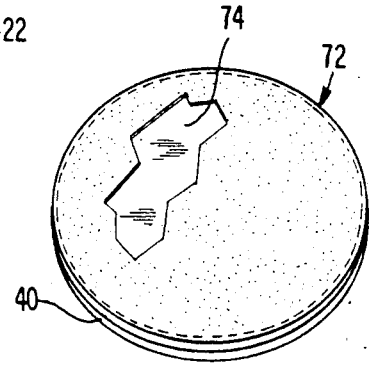
FIG. 5 is a top perspective view of the core element used in the novel invention shown in FIG. 4.

Shown in FIG. 5 is a top view of an internal cylindrical member, the core element 72 for example, comprised of the spongy material 40 and a disk 74. The disk 74 of this core element 72 is substantially flat. The disk 74 is constructed of Teflon TM, for example: The disk 74 is approximately one-sixteenth to one-thirty second of an inch thick, for example, and attached to the material 40 by means of epoxy, for example. The disk 74 facilitates the support function of the cephalic tool 10 as well as the shock insulation function of the cephalic tool 10 by insuring that any shock from carrying the board 14, for example, is distributed over the totality of the mounds 42 shown in FIG. 4. The disk 74 has a rounded edge to insure against creasing of the band 14.

Figure 6:
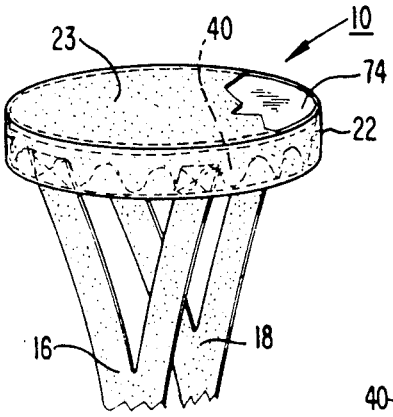
FIG. 6 is a partial perspective view of the cephalic tool.

The cephalic tool 10 as shown in FIG. 6 provides a unique construction which will enable the construction worker 12 to comfortably carry ceiling construction material on top of the head, manipulate same into place while protecting the surface of the head during the construction process.

Other suitable means for attachment other than the straps 16 and 18 shown in FIG. 6 may be used in conjunction with the cylindrical member 22 to provide a means for affixing the cephalic tool 10 to the human head. Accordingly, the present novel invention may be embodied in other specific forms without departing from its spirit or essential attributes. Therefore, reference should made to the appended claims rather than the foregoing specification and accompanying drawings for determining the scope of the novel invention.

What is claimed is:

1. A tool comprising manipulation means for cephalically manipulating a large flat board used for construction of a ceiling and attachment means to detachably affix the tool to a wearer's head, said manipulation means being shaped to fit on top of the wearer's head, said manipulation means being detachably affixable to the wearer's head and wherein said manipulation means further comprises a thick cylindrical member made of a soft spongy material, said member having a flat top surface, and said member being attached to the wearer's head by said attachment means.

2. The tool, according to claim 1, wherein said thick cylindrical member has a bottom surface, said bottom surface being concaved whereby said member is shaped to fit on top of the head.

3. The tool, according to claim 2, further comprising a cloth covering for said thick cylindrical member.

4. The tool, according to claim 3, wherein said thick cylindrical member is made of a soft rubber-like material having egg crate-like contours.

5. The tool, according to claim 4, wherein said attachment means comprises a left v-shaped strap connected to said cylindrical member, said left strap having a left end member with a first interconnecting means attached to said left end member and a right V-shaped strap with a right end member, said right strap having a second interconnecting means attached to said right end member, said first interconnecting means and said second interconnecting means being detachably and adjustably connectable to each other about the head.

6. The tool, according to claim 5, wherein each of said straps is attached to said covering by stitches comprised of thread.

7. The tool, according to claim 2, further comprising a thin firm disk adjacent said flat top surface and a containment means for containing said thick cylindrical member with said disk affixed to said cylindrical member.

* * * * *